United States Patent [19]

Scheinecker et al.

[11] 4,250,952

[45] Feb. 17, 1981

[54] STRAND GUIDING MEANS FOR GUIDING A STRAND IN A CONTINUOUS CASTING PLANT

[75] Inventors: Alois Scheinecker; Werner Scheurecker; Reinhard Hargassner, all of Linz, Austria

[73] Assignee: Voest-Alpine Aktiengesellschaft, Linz, Austria

[21] Appl. No.: 59,513

[22] Filed: Jul. 23, 1979

[30] Foreign Application Priority Data

Aug. 4, 1978 [AT] Austria ..... 5668/78

[51] Int. Cl.[3] ..... B22D 11/128

[52] U.S. Cl. ..... 164/448

[58] Field of Search ..... 164/153, 441, 442, 447, 164/448

[56] References Cited

U.S. PATENT DOCUMENTS 4,015,656 4/1977 Scheinecker et al. ..... 164/442 X

*Primary Examiner*—Robert D. Baldwin

*Attorney, Agent, or Firm*—Brumbaugh, Graves, Donohue & Raymond

[57] ABSTRACT

A strand guide arrangement to be used in a continuous casting plant has a frame displaceable by an adjustment drive, on which frame supporting elements are mounted which are adjustable to one side face of the strand. The frame is detachably fastened to a displacement ruler and is removable vertically upwardly after release of the fastening and retraction of the displacement ruler. The frame is connectable with the displacement ruler by a projection mounted on the frame or on the displacement ruler and insertable into a corresponding recess in the displacement ruler or in the frame, respectively.

6 Claims, 5 Drawing Figures

STRAND GUIDING MEANS FOR GUIDING A STRAND IN A CONTINUOUS CASTING PLANT

BACKGROUND OF THE INVENTION

The invention relates to a strand guide for continuous casting plants having a frame or section displaceable by an adjustment drive and on which supporting means, such as plates or rollers, are mounted so as to be adjustable to one side face of the strand. The section or the frame is detachably fastened to a displacement ruler of the adjustment drive and is removable vertically upwardly, after release of the fastening, upon retraction of the displacement ruler.

Such strand guides known from U.S. Pat. No. 4,015,656 are particularly required for laterally supporting cast strands that still have a liquid core and a relatively thin strand skin, in high-capacity continuous casting plants for casting slabs. With the construction known from U.S. Pat. No. 4,015,656, a separating element is provided between the displacement ruler and the frame or section, which element may be attached by screws. These screws, however, in the normal casting operation, have to accommodate all forces exerted by the extracted cast strand onto the lateral guiding rollers. The desired separation of the displacement ruler from the frame or section, however, takes place only if the frame or section has been welded together with the strand surface after a breakthrough of the liquid steel core of the strand. The strand is further extracted by the heavily dimensioned extraction arrangement at the end of the strand guiding arc. In this case, the screws will tear off with the construction according to U.S. Pat. No. 4,015,656, but the displacement ruler and its guide and drive elements will not be destroyed.

SUMMARY OF THE INVENTION

The invention aims at improving such a strand guide with a view to providing a safety arrangement for protecting the displacement ruler when a strand breakthrough occurs, which safety arrangement makes it possible to effect the desired separation of the frame from the displacement ruler solely by actuating the displacement ruler itself, without manual manipulations. The dimensioning of this safety arrangement is based merely on the release forces required, and not on the forces occurring during the normal casting operation and exerted by the strand.

This object is achieved according to the invention in that the frame or section is connectable with the displacement ruler by means of a projection directed in the displacement direction of the displacement ruler and provided at the frame or section or at the displacement ruler. The projection is insertable into a corresponding recess in the displacement ruler or in the frame or section, which supports the projection at all sides. Accordingly, the invention provides a fastening element which, on the one hand, accommodates only the horizontal, vertical, and tilting forces during normal operation, and, on the other hand, is detached at the occurrence of a predetermined tension force exerted by the displacement ruler onto the frame or section.

Advantageously, the projection is insertable into the recess in a friction-tight manner, wherein, according to a preferred embodiment, the projection is fastened to an intermediate piece mounted on the frame or section.

This projection is designed like a wedge and the corresponding recess in the displacement ruler is tapered.

A further advantageous embodiment is characterized in that a shearable bolt is provided between the frame or section and the displacement ruler for penetrating the projection.

BRIEF DESCRIPTION OF THE DRAWINGS

In the following detailed description preferred embodiments of the invention will be explained in more detail by way of the accompanying drawings, wherein.

DESCRIPTION OF PREFERRED EMBODIMENTS

Figure 1:
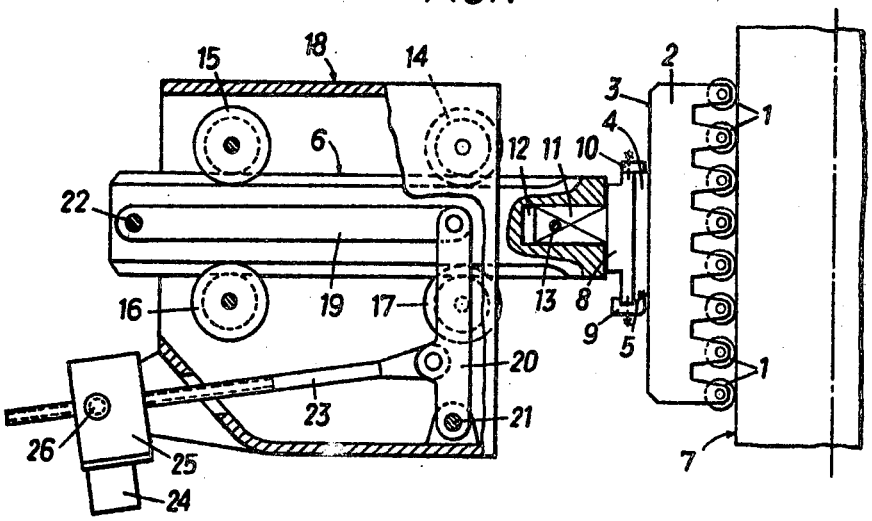
FIG. 1 is a side view of the strand guide including the adjustment drive, partly sectioned, according to one embodiment.

In FIG. 1, supporting elements designed as rollers 1 are rotatably mounted in a frame 2. At the frame outer side 3, a holding plate 4 is arranged, which plate includes a chamfer 5 at its lower part. This holding plate 4 serves for fastening the frame 2 to a displacement ruler 6. In order to make possible, on the one hand, the transmission of all forces from the strand 7 acting on the frame 2, to the displacement ruler 6, and on the other hand, to quickly separate the frame 2 from the displacement ruler 6, an intermediate piece 8 is provided. This intermediate piece 8 is fastened to the holding plate 4 by means of a clamp 9 contacting the chamfer 5 of the holding plate, and by means of a further fastening lug 10 on the upper side of the holding plate. The intermediate piece 8 comprises a cuboid-shaped projection 11, i.e. in the form of a right parallelepiped, which is inserted in an appropriate recess 12 of the displacement ruler 6. Because of the slight thickness of the displacement ruler, the cross section of the recess 12 as well as of the projection 11 is rectangular. For safely securing the intermediate piece in the displacement ruler, a bolt 13 is provided which bolt penetrates both the projection 11 and the displacement ruler 6.

The displacement ruler 6 is guided in the horizontal direction by means of at least two oppositely arranged roller pairs 14, 15; 16, 17 mounted in a housing 18, and actuated by a toggle lever linkage comprising connecting rods 19, 20. The housing 18 advantageously can be fastened to the mould guides, not illustrated. The connecting rods 19, 20 are articulately mounted in the housing and on the displacement ruler, respectively, by means of pins 21 and 22. A push rod 23 engages the connecting rod 20 and is actuated by a motor 24 via a self-locking intermediate gearing 25, so that an automatic movement of the frame in the load direction during operation is prevented. The intermediate gearing may e.g. consist of a worm wheel and a worm, the central bore of the worm wheel being designed as a spindle nut and the end of the push rod 23 being designed as a spindle. As the motor, a hydromotor of low capacity can be used. The motor and the intermediate gearing are pivotably mounted on bearing 26.

Tilting forces acting upon the frame and caused by the strand, vertical forces, and pressure forces acting outwards are transmitted from the projection 11 of the intermediate piece 8 to the displacement ruler 6. In case of a strand breakthrough, in which the rollers 1 or the frame 2 are welded together with the strand surface, a quick and simple separation of the frame 2 from the displacement ruler 6 can be achieved by retracting the displacement ruler 6 which causes the shearing off of the bolt 13. The bolt 13 is designed such that, on the one hand, its strength is sufficient for enabling a displacement of the frame 2, for instance if the strand format is changed, and, on the other hand, it is safely sheared off by the force of motor 24 when the displacement ruler 6 is retracted and the movement of the frame 2 is blocked.

Figure 2:
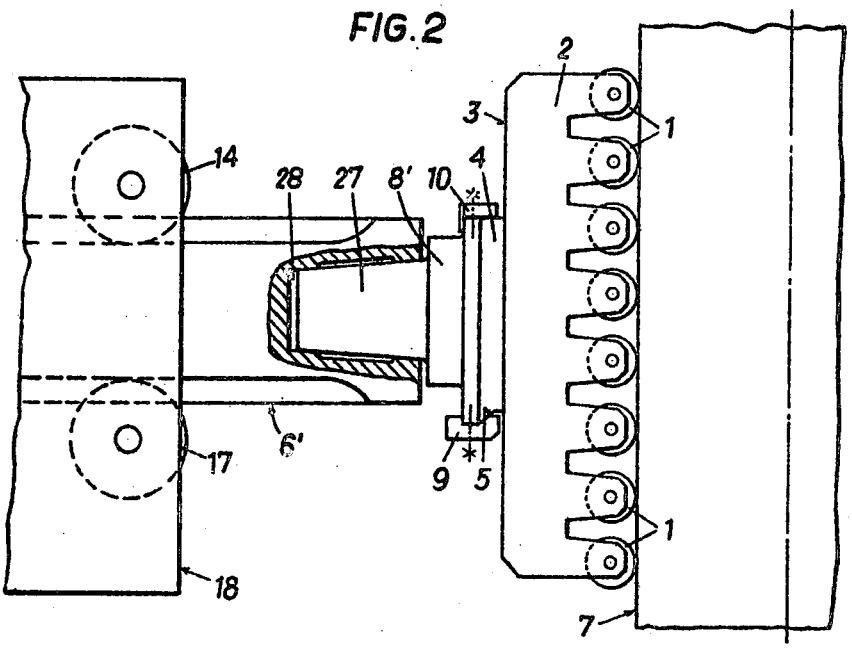
FIGS. 2 and 3 represent further embodiments, in an illustration analogous to FIG. 1.

In the embodiment according to FIG. 2, a wedge-shaped projection 27 is inserted in a tapered recess 28 of the displacement ruler 6', instead of the cuboid projection 11. The intermediate piece 8', during insertion into the displacement ruler 6', is pressed with a defined force against the displacement ruler and held between the wedge-shaped projection 27 and the recess 28 of the displacement ruler 6' by frictional forces.

Figure 3:
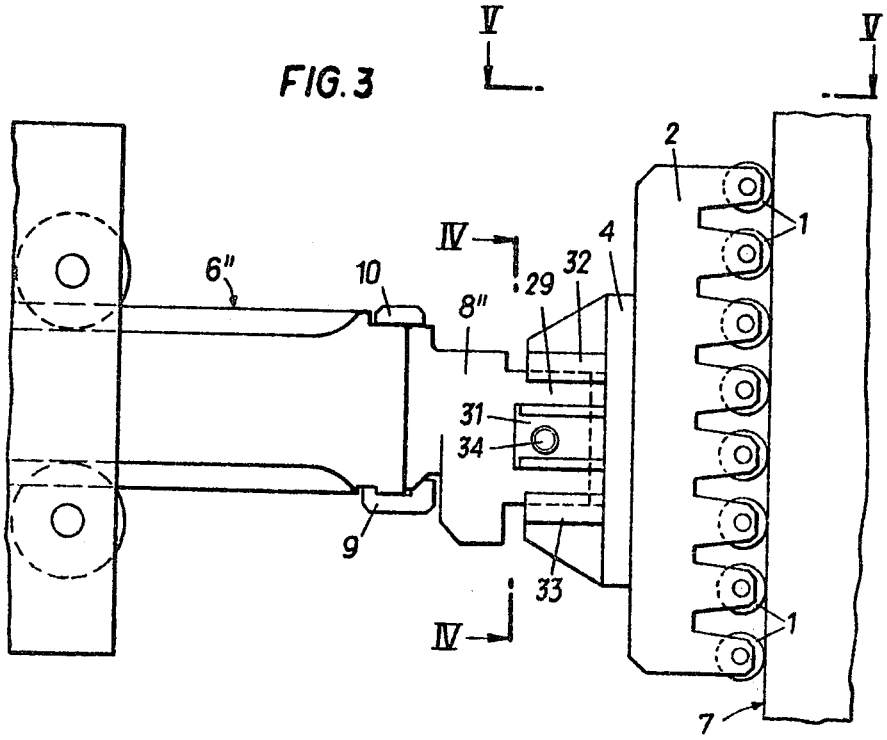
Figure 4:
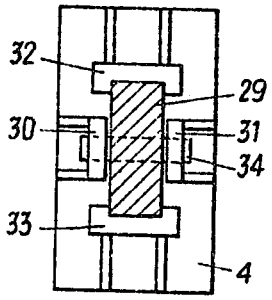
FIG. 4 is a sectioned representation according to line IV—IV of FIG. 3.
Figure 5:
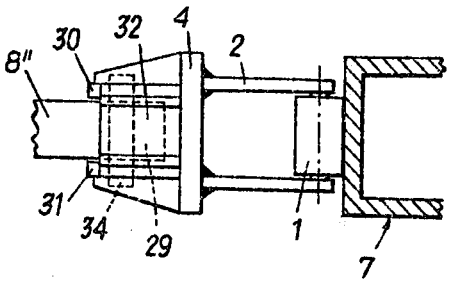
FIG. 5 is a sectioned representation according to line V—V of FIG. 3.

In the embodiment illustrated in FIG. 3, the intermediate piece 8'' is detachably mounted on the displacement ruler 6'' in a manner similar to the attachment of the holding plate 4 on the intermediate piece 8 according to FIGS. 1 and 2, i.e. by means of a clamp 9 and a fastening lug 10. The intermediate piece comprises a cuboid-shaped projection 29 at its end facing the frame 2, which projection is surrounded by four holding plates 30, 31, 32 and 33 which are rigidly mounted on the frame 2 (FIGS. 4 and 5). The holding plates 30, 31 arranged laterally of the cuboid projection, as well as the cuboid projection 29 itself, are penetrated by a bolt 34 that is designed such that it is sheared off when a certain tensional force produced by the displacement ruler 6'' occurs, whereby the frame 2, if welded to the strand surface during a strand breakthrough, will be separated from the displacement ruler 6''.

In any embodiments described, no manipulations by hand are necessary for detaching the frame part from the displacement ruler; it suffices to retract the displacement ruler by actuating the motor.

The clamps 9 are dimensioned such that, in case of a strand breakthrough, they will break if the frame 2 or the rollers 1 weld together with the strand surface and the strand continues to be extracted, so that also in this case the displacement ruler will not be damaged.

What we claim is:

1. In a strand guiding means for guiding a strand in a continuous casting plant, of the type including a displacement ruler, an adjustment means for displacing said displacement ruler, a frame part, supporting elements mounted on said frame part and adjustable to one side face of said strand, and fastening means for detachably connecting said frame part to said displacement ruler, said frame part being adapted to be vertically upwardly removed after release of said fastening means and retraction of said displacement ruler, the improvement characterized in that said fastening means comprises a projection associated with one of the connected parts, i.e. said frame part and said displacement ruler, and directed in the displacement direction of said displacement ruler for fastening said frame part to said displacement ruler, and a corresponding recess associated with the other of the connected parts, said projection having a polygonal cross-sectional shape and being insertable into said corresponding recess so as to be supported on all of its sides, said projection being dimensioned so as to be able to transmit forces caused by normal operations and to withstand shear forces during retraction of the displacement ruler after a breakthrough of the strand core has frozen the frame part to the strand.

2. A strand guiding means as set forth in claim 1, wherein said supporting elements are plates.

3. A strand guiding means as set forth in claim 1, wherein said supporting elements are rollers.

4. A strand guiding means as set forth in claim 1, wherein said projection is insertable into said recess in a friction-tight manner.

5. A strand guiding means as set forth in claim 4, wherein said fastening means comprises an intermediate piece supporting said projection and mounted on said frame part, said projection being designed like a wedge, and said corresponding recess being located in said displacement ruler and being designed with a corresponding tapered shape.

6. A strand guiding means as set forth in claim 1, wherein said fastening means further comprises a shearable bolt provided between said frame part and said displacement ruler and penetrating said projection, said bolt being sheared off by retraction of the displacement ruler after a breakthrough has frozen the frame part to the strand.

* * * * *